US010190780B2

(12) United States Patent
Essert et al.

(10) Patent No.: US 10,190,780 B2
(45) Date of Patent: Jan. 29, 2019

(54) DOOR FOR A HOUSEHOLD APPLIANCE, AND HOUSEHOLD APPLIANCE HAVING A DOOR

(71) Applicant: BSH Hausgeräte GmbH, Munich (DE)

(72) Inventors: Michael Essert, Östringen (DE); Manfred Hintermayer, Karlsruhe (DE); Kerstin Sickert, Bretten (DE); Reinhard Wiedenmann, Weingarten (DE)

(73) Assignee: BSH Hausgeräte GmbH, Munich (DE)

( * ) Notice: Subject to any disclaimer, the term of this patent is extended or adjusted under 35 U.S.C. 154(b) by 45 days.

(21) Appl. No.: 15/328,069

(22) PCT Filed: Aug. 4, 2015

(86) PCT No.: PCT/EP2015/067872
§ 371 (c)(1),
(2) Date: Jan. 23, 2017

(87) PCT Pub. No.: WO2016/020344
PCT Pub. Date: Feb. 11, 2016

(65) Prior Publication Data

US 2017/0205079 A1 Jul. 20, 2017

(30) Foreign Application Priority Data

Aug. 7, 2014 (DE) ..... 10 2014 215 613

(51) Int. Cl.
*F24C 15/02* (2006.01)

(52) U.S. Cl.
CPC ..... *F24C 15/02* (2013.01); *F24C 15/024* (2013.01)

(58) Field of Classification Search
CPC ..... F24C 15/02
(Continued)

(56) References Cited

U.S. PATENT DOCUMENTS 7,036,499 B2 * 5/2006 Bartmann ..... E05B 7/00 126/191
7,234,457 B2 * 6/2007 Bartmann ..... E05B 7/00 126/192

(Continued)

FOREIGN PATENT DOCUMENTS

CN 201983312 U 9/2011
DE 3935803 A1 5/1991

(Continued)

OTHER PUBLICATIONS

International Search Report PCT/Ep2015/067872 dated Oct. 27, 2015.

(Continued)

*Primary Examiner* — Avinash Savani
(74) *Attorney, Agent, or Firm* — Michael E. Tschupp; Andre Pallapies; Brandon G. Braun

(57) ABSTRACT

A door for a household appliance includes a plate-type base part and a handle which is arranged on the base part and includes a movable handle part. Connected to the handle part is a coupling apparatus which is configured to pivot the handle part relative to the base part as a function of a movement of the door. The coupling apparatus includes a coupling rod arranged on the handle part, a return spring arranged on the coupling rod, and a single-run cable pull having an end which faces the handle part and is connected to the coupling rod. Provision is further made for a locking mechanism to limit a movement of the coupling rod.

23 Claims, 6 Drawing Sheets

(58) Field of Classification Search
USPC ..... 126/197, 200
See application file for complete search history.

(56) References Cited

U.S. PATENT DOCUMENTS

| | | | | |
|---|---|---|---|---|
| 7,445,005 | B2 * | 11/2008 | Bartmann | E05B 7/00 126/192 |
| 2005/0022802 | A1 | 2/2005 | Bartmann et al. | |
| 2008/0282504 | A1 | 11/2008 | Baumeister et al. | |

FOREIGN PATENT DOCUMENTS

| | | | |
|---|---|---|---|
| EP | 0659960 | B1 | 4/2001 |
| EP | 2096360 | A2 | 9/2009 |
| EP | 2096361 | B1 | 11/2015 |
| EP | 2581666 | B1 | 4/2016 |
| GB | 2183152 | A | 11/1986 |

OTHER PUBLICATIONS

National Search Report DE 10 2014 215 613.0 dated Mar. 1, 2016.
National Search Report CN 201580042368.7 dated Mar. 2, 2018.

* cited by examiner

DOOR FOR A HOUSEHOLD APPLIANCE, AND HOUSEHOLD APPLIANCE HAVING A DOOR

CROSS REFERENCES TO RELATED APPLICATIONS

This application is the U.S. National Stage of International Application No. PCT/EP2015/067872, filed Aug. 4, 2015, which designated the United States and has been published as International Publication No. WO 2016/016096 A1 and which claims the priority of German Patent Application, Serial No. 10 2014 215 613.0, filed Aug. 7, 2014, pursuant to 35 U.S.C. 119(a)-(d).

BACKGROUND OF THE INVENTION

The invention relates to a door for a household appliance, having a plate-type base part on which a movable handle is arranged. Furthermore the door comprises a coupling apparatus which is connected to the handle and by means of which the handle, as a function of the movement of the door, can be pivoted relative to the base part. Furthermore the invention also relates to a household appliance having a door of this type.

Ovens which have a door for closing a cooking compartment are known from the prior art. Doors of this type usually have a handle on the front panel, which can be gripped by a user in order to be able to pivot the door. In order also to design the accessibility of the door to be user friendly when it is in a fully open position, handles of this type can be pivoted relative to the plate-type base part, so that they can also be easily gripped in this open position of the door.

With conventional embodiments, a device which comprises two bracing cables is available for this purpose. The pivoting mechanism of the handle is embodied with a double bracing cable guide, wherein when flap doors cannot be retracted into the housing of the household appliance, the connection of this bracing cable guide to the door hinge and its translation is realized. In embodiments in which a door of this type, in the fully open state, is also retracted into the housing of the household appliance, the connection of the two bracing cables with a double bracing cable guide likewise takes place in the bearing top and by way of a rotatably mounted axis in the lower door region. When the door is opened, the pivoting motion of the handle is transmitted to the lower door axis.

The conventional embodiments are of a relatively complicated and component-intensive design. As a result, the assembly and the movement principle for force transmission is also relatively complex. As a result, it may also be more prone to functional errors.

A household appliance door with a single-run cable pull for a pivotable handle is also known from DE 10 2011 084 300 A1.

BRIEF SUMMARY OF THE INVENTION

It is the object of the present invention to create a door for a household appliance and a household appliance of this type, with which a movement of the handle which is compact, thus structured simply and operates in a functionally reliable manner is improved.

This object is achieved by a door and a household appliance according to the independent claims.

An inventive door for a household appliance comprises a plate-type base part, on which a handle with a movable handle part is arranged. Furthermore, the door comprises a coupling apparatus which is connected to the handle part and by means of which the handle part, as a function of the movement of the door, can be pivoted relative to the base part. The coupling apparatus comprises a merely single-run cable pull. One essential idea behind the invention is that at its end facing the handle part, the cable pull is connected to a coupling rod arranged on the handle part side, on which coupling rod a return spring is arranged, wherein the coupling rod is connected to a locking mechanism for at least a movement limiting of the coupling rod. As a result, the pivoting motion of the handle part is also improved with a single-run cable pull. This pivoting motion can take place in a more precise and play-free manner so that an undesired wobbling of the handle part is prevented. This improved movement is achieved by mechanically stable elements which are also coupled in a stable manner.

The locking mechanism preferably has a half-shell-shaped supporting molding or a groove, at the end of which the coupling rod is accommodated, in particular in a fixed position relative to the locking mechanism. As a result, a force fit which holds the coupling rod is also realized.

The locking mechanism preferably has a key-shaped end part, which has a U-shaped movement limiter. Through this shape the locking mechanism can be coupled in a secure and stable manner to other components, and the locking element is also robust in respect of forces acting thereupon.

The handle preferably has a handle element which is fixed in particular on the base part, relative to which handle element the handle part can be pivoted.

In particular, the handle element has a front wall and a rear wall, wherein the locking mechanism at least with the movement limiter extends into a clearance between the front wall and the rear wall and rests on an inner side of the front wall or on an inner side of the rear wall for movement limiting of the coupling rod. As a result, the coupling rod is retained in the peripheral direction about its longitudinal axis and thus locked with certain play.

In a connection direction oriented at right angles between the two walls, the movement limiter is preferably arranged with play in the clearance between the walls.

In particular, the handle part has a stop for the axial stop of the locking mechanism when viewed in the direction of a longitudinal axis of the coupling rod. As a result, the coupling rod is also secured in terms of movement in the direction of the longitudinal axis by a simple and space-saving embodiment.

Preferably the return spring is wound around the coupling rod and a support loop of the return spring embodied between spring windings is available. As a result, the return spring is positioned in a stable manner and through its specific shape, the spring force can be generated and transmitted in an improved manner so that the handle part moves without wobbling.

A comprehensive and complex embodiment of a double bracing cable guide is no longer required. On account of the return spring and its specific connection at both ends, it is furthermore also ensured with a single-run cable pull of this type assembled in a simple manner for the handle to automatically return back to its starting position if the door is closed again.

The handle rod and handle brackets are arranged on the handle part.

Provision is preferably made for the first end of the return spring to likewise be fixedly connected to a holding element, which is connected to the cable pull. As a result, a mechanically stable connection and a movement guide transmitted in a very precise and direct manner take place without play.

Provision can however also be made for the end of the return spring to be connected to the handle part at a different point to the handle part-side end of the cable pull.

Provision is preferably made for the return spring to be pretensioned at least in an open end position of the door and a pivoting position of the handle part involved therewith. By means of this embodiment, when the door is automatically closed by the return spring, the handle part can be transferred from the pivoting position into an unpivoted basic position.

Provision is preferably made for the return spring to be pretensioned at least in a closed end position of the door and an unpivoted basic position of the handle part involved therewith. This also brings advantages to that effect in that this basic position is then also almost fixedly retained and no unwanted wobbling of the handle part takes place.

The handle is assembled in particular from the handle part and the handle element.

Provision is preferably made for the cable pull to be connected with its end facing away from the handle to a pivot axis of the door. This is particularly advantageous in doors which are arranged retracted in the housing of the household appliance in the open end position.

Alternatively provision can also be made for the cable pull to be connected with its end facing away from the handle to a coupling element, which can make contact with a hinge tappet of a hinge piece of a door hinge and thus no permanently fixed connection is embodied between the coupling element and the hinge tappet. This is advantageous in the case of a door which can be retracted into the household appliance. Provision can also be made for a fixed connection to be embodied between the coupling element and the hinge tappet. In this respect it is advantageous if the door is not a door which can be retracted into the housing of the household appliance but instead a flap door.

The coupling element can then preferably be a pull spring, which can be changed in terms of length as a function of the door movement and the movement of the hinge tappet which is connected thereto. Provision can also be made for the coupling element to be a longitudinally stable sliding carriage, which can be changed in terms of its position as a function of the door movement and the movement of the hinge tappet which is connected thereto. In particular, the handle part of the door is brought into one of the end positions by a return spring which engages in or directly on the handle part. With a single-run cable pull, the door movement is transmitted from a door hinge or a door pivot axis onto the handle and in particular the handle part. The single-run cable pull is inserted or clipped in the bearing top of the handle part through a socket which is non-detachably connected to the cable and which can be injected or cast, or a similar connection.

In an advantageous embodiment of the household appliance, which may in particular be a cooking appliance, such as an oven, the door is provided to close the cooking compartment.

Provision can be made here for the door to be retracted in the household appliance in the open end position. With embodiments of this type, it is advantageous if the single-run cable pull is always connected to the door axis.

In embodiments in which the household appliance has a flap door and thus a door which cannot be retracted into the housing of the household appliance, the mechanism for transmitting the hinge position can be embodied differently by the hinge tappet, wherein this is dependent on the cable guide.

Provision can be made here for the cable to be coupled to a pull spring, which is tensioned by the hinge tappet or on the other hand is connected to a sliding carriage, which is moved by the hinge tappet, wherein with the second solution the return spring is the only spring located in the handle. A further spring then does not comprise the mechanics required to pivot the handle.

Provision is preferably made for a door hinge to have a hinge housing and a hinge bracing rotatably connected therewith, and the hinge bracing can make contact with the door and the hinge housing is arranged in a household appliance housing. This is advantageous in the case of a retractable door. In this respect it is also advantageous since the larger hinge housing which requires more installation space is thus not arranged in the door and does not take up any unnecessary installation space. Furthermore, additional components can be accommodated in the hinge housing. The hinge movement is then preferably transmitted into the door by way of a hinge tappet. This may represent the hinge bracket or be coupled to the hinge bracket. The linear movement of the hinge tappet activates the single-run cable pull and accordingly transmits the movement onto the handle part.

If the door is a flap door and can thus not be retracted into the household appliance, a fixed connection between the hinge bracket and the door is advantageous.

Alternatives in respect of the cable guide can be embodied. This can thus take place on the one hand directly behind a door inner glass of the door. Since a door usually has at least one door inner glass and one door outer glass, which are arranged at a distance from and running in parallel to one another, this results in an alternative in respect of the arrangement. At least one further door intermediate glass is then usually embodied, so that the afore-cited cable guide is arranged at a distance from the door outer glass.

Accordingly, provision can however also be made in an alternative embodiment for the cable guide to run and be arranged directly behind the front glass window and thus the door outer glass.

The return spring is preferably tensioned when the handle part is pivoted and with the counter movement the handle part is automatically brought into the starting position by the return spring.

In view of the concept of the single-run cable pull, this indicates that only one cable is present, which is not arranged to run parallel in a double or multi-run manner, but instead extends with its ends only between the handle and the door axis or the door hinge so that only one bracing cable is embodied.

Further features of the invention result from the claims, the figures and the description of the figures. The features and combinations of features cited above in the description and also the features and combinations of features shown in the figures and/or in the description of the figures may be used not only in the combination indicated in each case but also in other combinations or alone, without going beyond the scope of the invention.

BRIEF DESCRIPTION OF THE DRAWINGS

Exemplary embodiments of the invention will now be described by reference to the schematic drawings, in which.

DETAILED DESCRIPTION OF EXEMPLARY EMBODIMENTS OF THE PRESENT INVENTION

Figure 1:
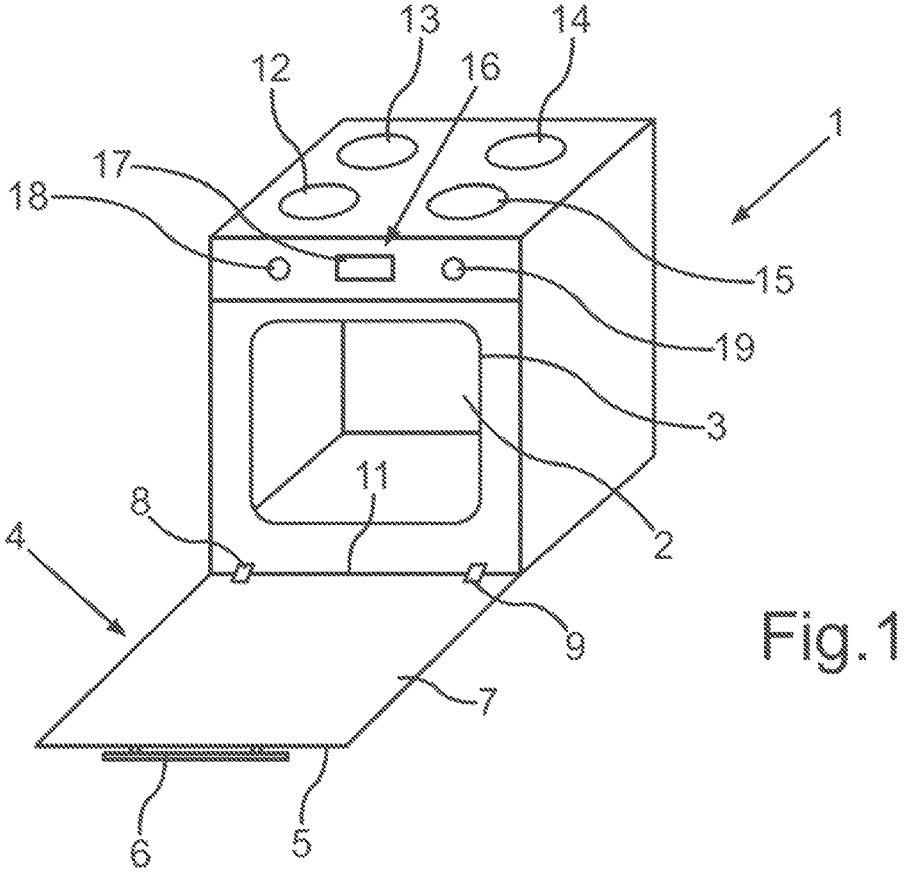
FIG. 1 shows a perspective representation of a first exemplary embodiment of an inventive household appliance.

In the Figures, similar or functionally similar elements are provided with the same reference numerals.

FIG. 1 shows a perspective representation of a household appliance embodied as an oven 1. The oven 1 comprises a cooking compartment 2, which is bounded by a muffle 3. A loading opening of the muffle 3 can be closed at the front by a door 4. In the exemplary embodiment the door 4 is assembled from a plurality of door glasses, wherein to this end a door outer glass and at a distance therefrom at least one door intermediate glass, and in turn at a distance therefrom a door inner glass, which is arranged nearest to the cooking compartment 2, are embodied. Furthermore, a handle 6 is arranged on an outer side 5 of the door 4, said handle being movable, in particular pivotable, relative to a plate-type base part 7 which comprises the cited glasses. To this end the handle 6 comprises a handle part 6*a* (FIG. 3) and a handle element 6*b*. The handle part 6*a* is pivotable relative to the handle element 6*b* and relative to the base part 7. The handle element 6*b* is arranged fixed to the base part 7 and can therefore not be pivoted.

The door 4 is attached to a housing 10 of the oven 1 by way of hinges 8 and 9 and can be pivoted about a horizontal axis 11 disposed therebelow.

Purely by way of example and not to be understood as restrictive both in terms of position and also in number, provision is furthermore made for cooking zones 12, 13, 14 and 15 as well as a control device 16 with a display unit 17 and control elements 18 and 19.

In the exemplary embodiment according to FIG. 1, the door 4 is embodied as a flap door, which in the fully open state shown in FIG. 1 or the open end position, is not countersunk into the housing 10.

Figure 2:
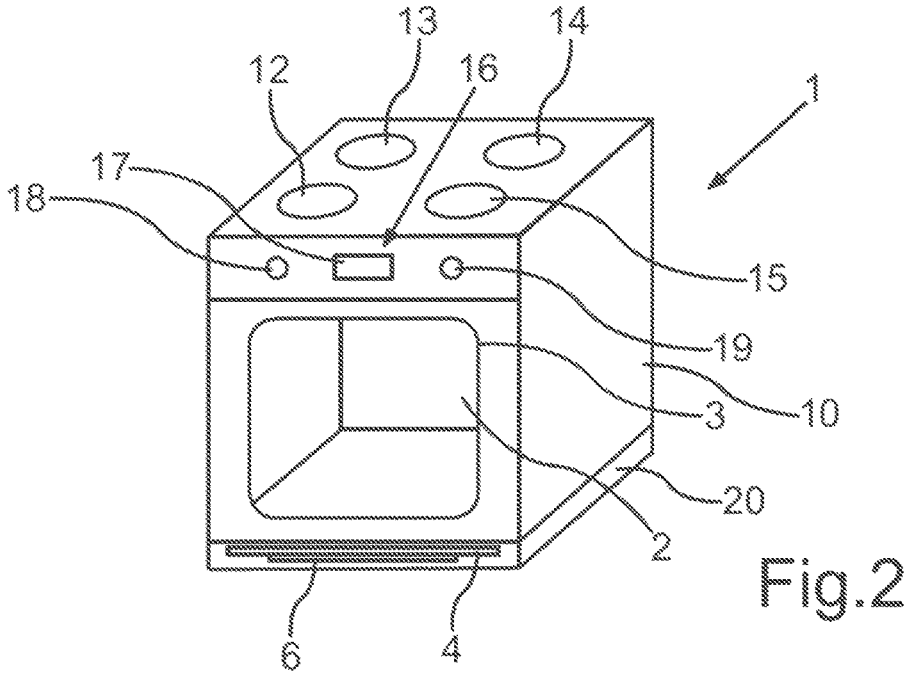
FIG. 2 shows a perspective representation of a second exemplary embodiment of an inventive household appliance.

FIG. 2 shows a further exemplary embodiment of an oven 1, in which, contrary to the representation in FIG. 1, a door 4, shown in the open end position, is positioned countersunk in the housing 10 in a space 20.

In the open end positions of the door 4 shown in FIG. 1 and FIG. 2, the handle 6 or the handle part 6*a* is in a pivot position which indicates that handle regions such as a handle rod are arranged on the front and can be easily gripped by a user.

If a door 4 is transferred from its shown open end position into a closed end position, the handle part 6*a* is then automatically guided back from its pivot position into the unpivoted basic position.

Figure 3:
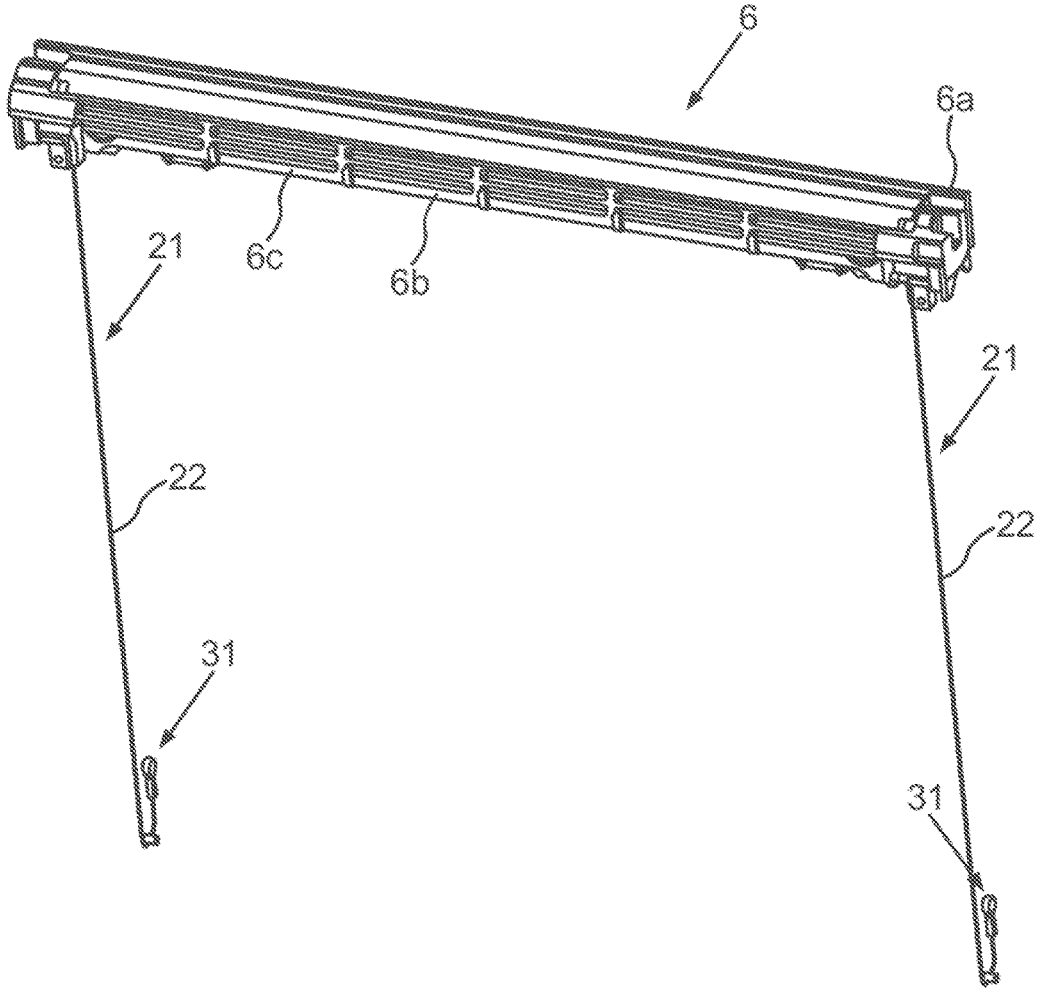
FIG. 3 shows a first perspective view of a handle of a door of the household appliance according to FIG. 1.

To this end, according to a first exemplary embodiment in FIG. 3, provision is made for the handle part 6*a* to be mechanically coupled to a coupling apparatus 21. The coupling apparatus 21 comprises a single-run cable pull 22, which is fixedly connected with a first end 23 (FIG. 5) to the handle part 6*a*. To this end, provision is made for a coupling element 24, such as for instance a bolt or a socket, to be arranged on the handle part 6*a*. Furthermore, a return spring 25 is provided.

In the representation in FIG. 3, it can also be seen that preferably two single-run cable pulls 22 are connected in each case to the handle 6 and in this respect are coupled to the opposing ends of the straight longitudinal handle 6.

The cable pulls 22, which are embodied to be the same both functionally and specific to the component, are explained further below in respect of their coupling to the handle 6 only with the aid of one cable pull. In this regard a cable pull 22 is connected at its end 23 facing the handle part 6*a* to a coupling rod 26 (FIG. 4, 5, 6) arranged on the handle side. The coupling rod 26 is connected to the movable handle part 6*a*, which also represents a bearing top of the handle 6. On the other hand, the fixed handle element 6*b* represents a bearing bottom.

According to the representation in FIG. 3, the handle element 6*b* to some extent comprises a fanned or hollow profile structure, wherein in this regard a rear wall 6*c* and a front wall 6*d* are formed. The rear wall 6*c* faces the cooking compartment 2 when the door 4 is closed, or is positioned closer than the front wall 6*d*.

Figure 4:
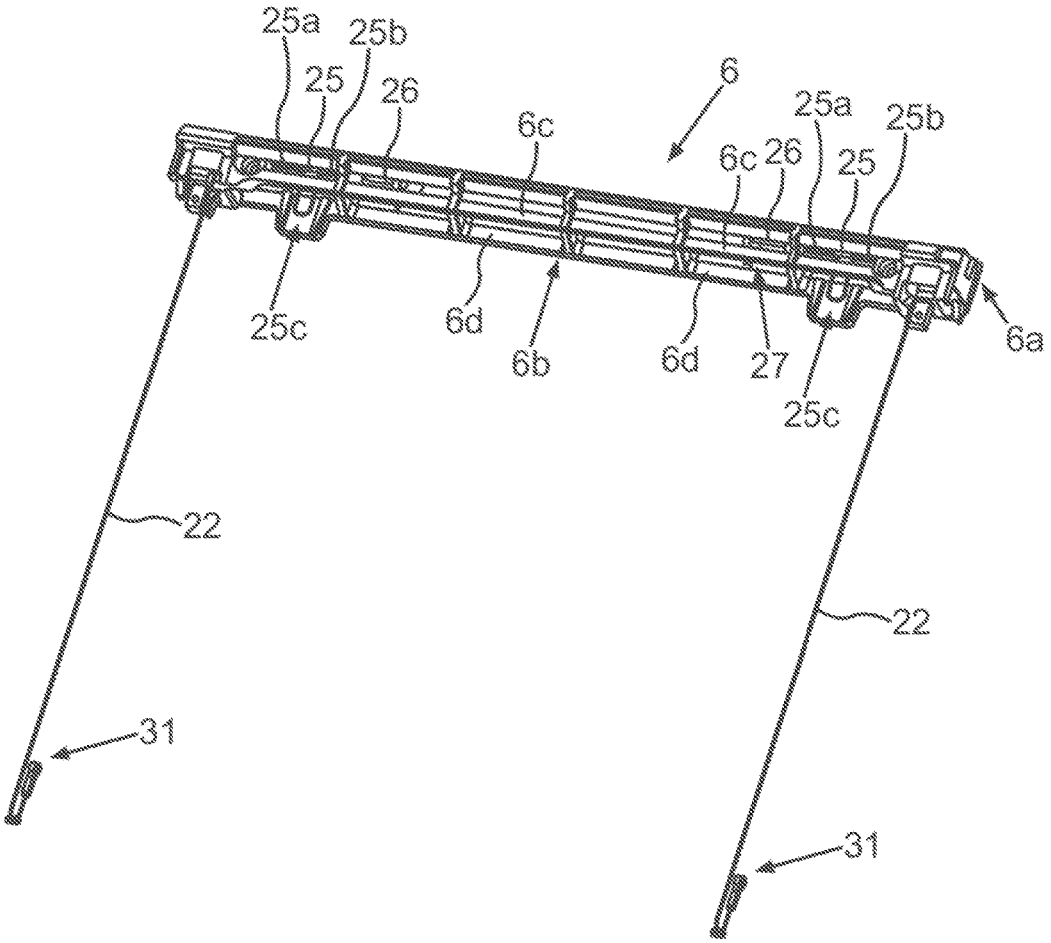
FIG. 4 shows a second perspective view of a handle of a door of the household appliance according to FIG. 1.

As can be seen more clearly in the perspective representation in FIG. 4, connecting webs are also embodied between the rear wall 6*c* and the front wall 6*b*, so that in this respect a type of hollow chamber structure is created.

The return spring 25 is arranged on the coupling rod 26. The return spring 25 is wound around the coupling rod 26 and thus surrounds this in regions along its entire length. The return spring 25 comprises a first spring winding 25*a* and a second spring winding 25*b* which are wound circumferentially around the coupling rod 26. Viewed in the direction of the longitudinal axis A (FIG. 5) of the coupling rod 26, a projecting support loop 25*c* of the return spring 25 is embodied between the spring windings 25*a* and 25*b*.

Furthermore, the embodiment also comprises a locking mechanism 27, which, for at least a movement limiting of the coupling rod 26, is embodied on the one hand in the axial direction and on the other hand in the peripheral direction about the longitudinal axis A. In particular, this locking mechanism 27 thus restricts the movement of the coupling rod 26 and thus also of the return spring 25 arranged in a fixed position in particular thereon and thus also designs the coupling with the cable pull 22 such that the handle part 6*a* can be defined and can be pivoted without wobbling and without jerk.

Figure 5:
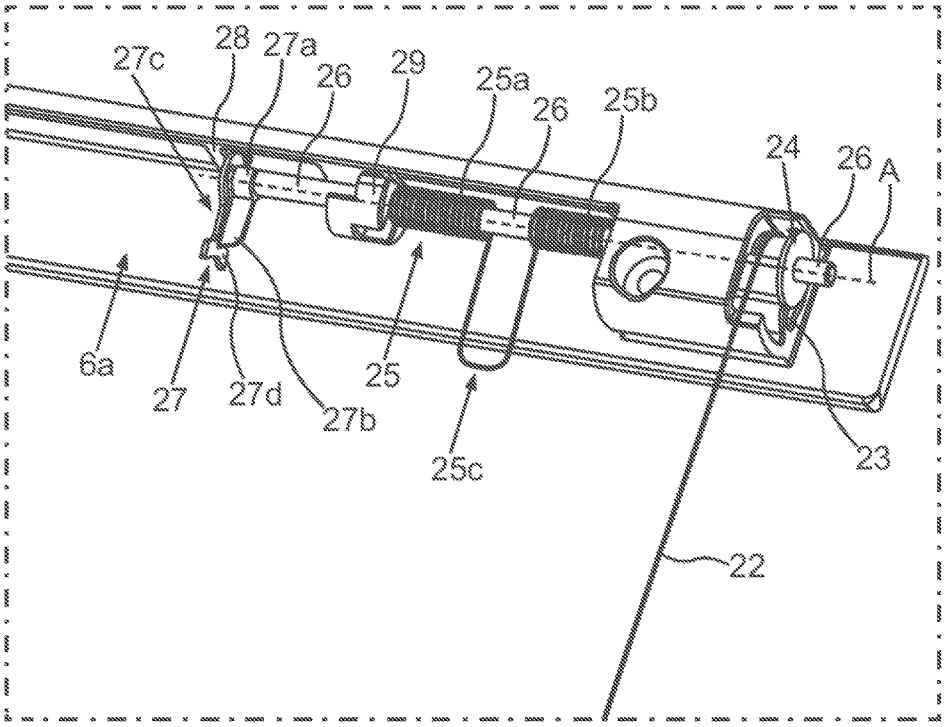
FIG. 5 shows a perspective view of subcomponents of the handle according to FIGS. 3 and 4.

FIG. 5 shows a perspective representation of an enlarged partial cutout according to the view in FIG. 4, wherein the handle element 6*b* is removed however, so that the coupling rod 26 and the return spring 25 and also the locking mechanism 27 can be seen in more detail and furthermore the connection of the single-run cable pull 22 by way of the coupling element 24 to the coupling rod 26 can also be seen.

The locking mechanism 27 which is a single-piece element, in particular made of plastic, has a half-shell-shaped supporting molding 27*a* or a groove at the end of which the coupling rod 26 is accommodated. In this regard, the locking mechanism 27 is arranged at the end opposing the end to which the cable pull 22 is coupled to the coupling rod 26 by way of the coupling element 24. The coupling rod 26 is accommodated in particular in a fixed position in the locking mechanism 27 so that a clamping fit is in particular also realized.

Aside from this half-shell-shaped supporting molding 27*a*, the locking mechanism 27 comprises a reinforcing rib 27*b*, which leads both to the receptacle 27*a* and also connects to a key-shaped end part 27*c*. A U-shaped movement limiter 27*d* is embodied on the key-shaped end part 27*c*, which thus also represents a fin shape. In the final assembled state shown in FIG. 5, the locking mechanism 27 is arranged resting on a stop 28, wherein the stop 28 is embodied in one piece on a ceiling wall of the handle part 6*a*. As a result, the coupling rod 26 is held in the axial direction.

Figure 6:
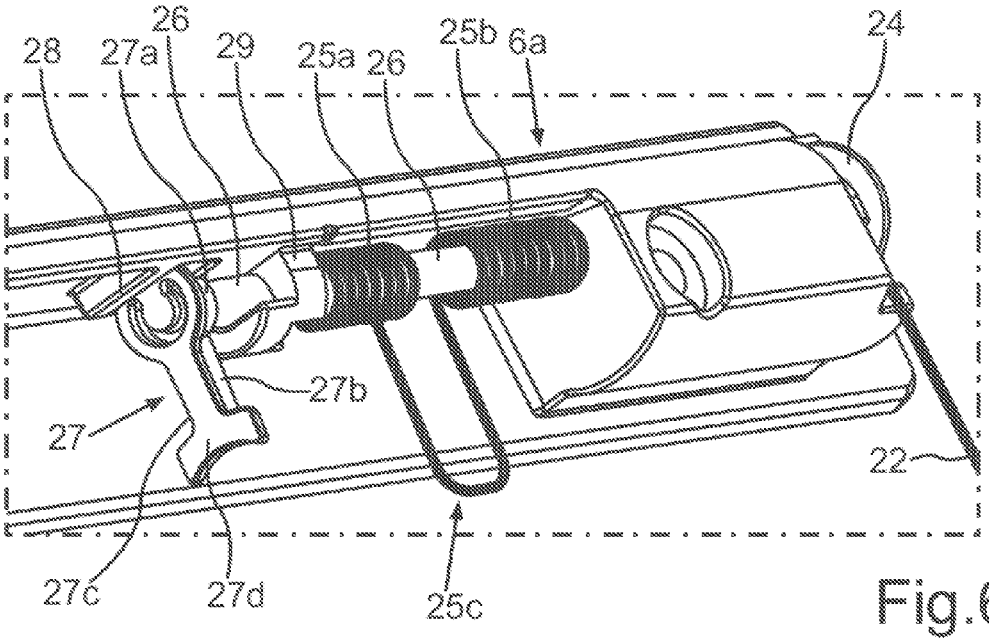
FIG. 6 shows a further perspective view of subcomponents of the handle according to FIG. 5.

In a further perspective representation in FIG. 6, the embodiment of the components in FIG. 5 is shown again so that the locking mechanism 27 can also be seen from the side facing the stop 28. Furthermore, it can also be seen that the coupling rod 26 has a supporting molding 29 which connects directly to the first spring winding 25*a*, in which the coupling rod 26 is received and thus mounted. The supporting molding 29 to this end comprises a feed through, through which the coupling rod 26 extends. Provision is made, in accordance with the sectional representations in FIG. 7 to FIG. 9, for the return spring 25 to be pretensioned relative to the handle element 6*b* both in the state in which the handle part 6*a* is not pivoted and in a basic position, and also in the pivoted state of the handle part 6*a*. To this end the support loop 25*c* rests mechanically on specific elements, in particular on the handle part 6*a*, by forming its spring force.

Figure 7:
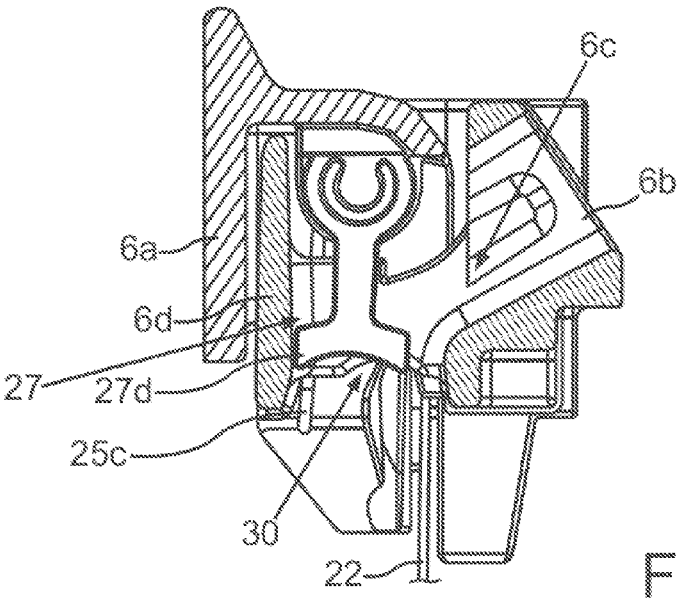
FIG. 7 shows a side view of an embodiment of the components of the handle according to FIGS. 3 and 4.
Figure 8:
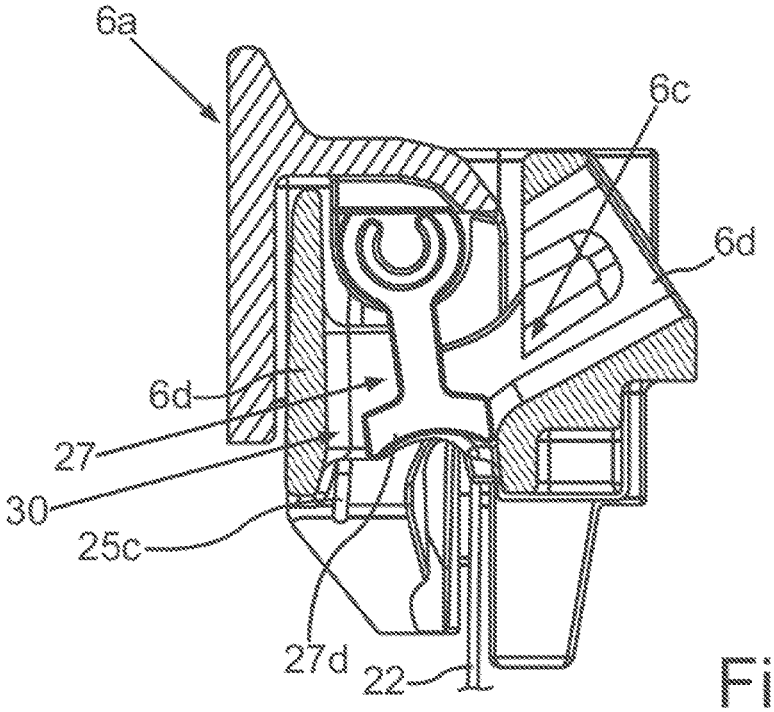
FIG. 8 shows a further side view of an embodiment of the components of the handle according to FIGS. 3 and 4 with a position of a locking mechanism which differs from the representation in FIG. 7.

In the representation in FIG. 7, the handle 6, as shown in FIG. 3 and FIG. 4, is shown in a sectional representation. It can be seen here that the locking mechanism 27 at least with the movement limiter 27*b* immerses or extends into a clearance 30 between the rear wall 6*c* and the front wall 6*d*, and then as a function of the embodiment and thus specific design of the handle, in particular of the handle part 6*a* and/or the handle element 6*b*, and/or as a function of the position of the handle part 6*a* relative to the handle element 6*b*, either rests on an inner side of the front wall 6*b*, or, as shown in FIG. 8, on an inner side of the rear wall 6*c*, and a movement limitation is thus realized accordingly. Provision is thus made in particular for the locking mechanism 27 to be defined with a defined play, which results due to the size of the movement limiter 27*d* and the size of the clearance 30.

Figure 9:
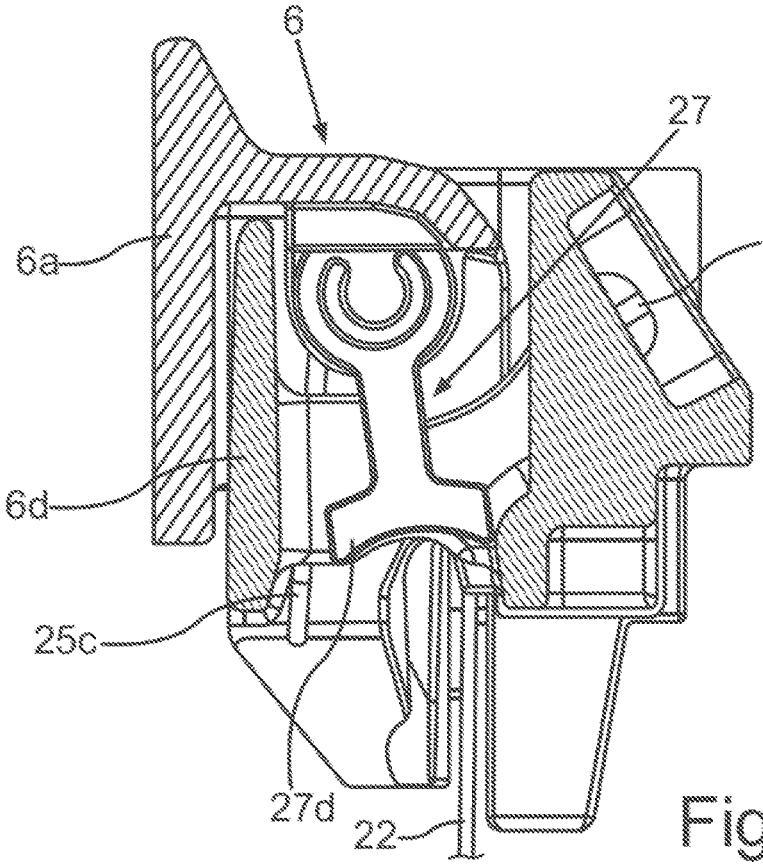
FIG. 9 shows a further side view of an embodiment of the components of the handle according to FIGS. 3 and 4.

A further exemplary embodiment of a handle 6 with a single-run cable pull 22 is shown in FIG. 9, which, in respect of the embodiment of the clearance 30 and thus the arrangement of the walls 6*c* and 6*d*, is embodied differently to the embodiments in FIG. 7 and FIG. 8. In this regard provision can also be made for the handle element 6*b* in particular to be embodied differently on the opposing ends of its longitudinal extension and for instance to have a realization according to FIG. 7 and FIG. 8 at one end and a realization according to FIG. 9 at the other end.

If the door 4 is now transferred starting from the closed end position of the door 4 into the open end position shown in FIG. 2, the cable pull 22 is moved about the door axis 11. An end 31 (FIG. 3, 4) of the cable pull 22 facing away from the handle is in particular connected to a socket connected in a fixed manner to the door axis 11.

The rotational movement of the door axis 11 causes the handle 6 to pivot into its pivot position by way of the coupling apparatus 21 and in particular the single-run cable pull 22, as a result of which the return spring 25 is put under pressure and passes over into a greater pretensioned state.

If it is assumed that the door 4 passes back into the closed end state or the end position, the handle part 6*a* is automatically passed from the pivot position into the base position on account of the pretensioned spring force of the return spring 25. Provision can be made for the cable guide of the cable pull 22 to be arranged directly behind a door inner glass, which is thus a door glass of a glass pack arranged closest to the cooking compartment 2.

The invention claimed is:

1. A door for a household appliance, comprising:

a plate-type base part, a handle arranged on the base part and including a movable handle part, a coupling apparatus connected to the handle part and configured to pivot the handle part relative to the base part as a function of a movement of the door, said coupling apparatus comprising a coupling rod arranged on the handle part, a return spring arranged on the coupling rod, and a single-run cable pull having an end which faces the handle part and is connected to the coupling rod, and a locking mechanism configured to limit a movement of the coupling rod.

2. The door of claim 1, wherein the locking mechanism includes a half-shell-shaped supporting molding having one end, in which the coupling rod is received.

3. The door of claim 2, wherein the coupling rod is received in the end of the supporting molding in a fixed position relative to the locking mechanism.

4. The door of claim 1, further comprising a U-shaped movement limiter provided on a key-shaped end part of the locking mechanism.

5. The door of claim 1, wherein the handle has a handle element, said handle part being pivotable relative to the handle element.

6. The door of claim 5, wherein the handle element is fixed on the base part.

7. The door of claim 5, wherein the handle element has a front wall and a rear wall, and further comprising a U-shaped movement limiter, said locking mechanism being configured to extend with the movement limiter into a clearance between the front wall and the rear wall and to rest on an inner side of the front wall or on an inner side of the rear wall for limiting the movement of the coupling rod.

8. The door of claim 7, wherein the movement limiter is arranged with play in the clearance between the front and rear walls, as viewed in a connection direction which is oriented at a right angle between the front and rear walls.

9. The door of claim 1, wherein the coupling rod defines a longitudinal axis, said handle part having a stop for axially stopping the locking mechanism when viewed in a direction of the longitudinal axis of the coupling rod.

10. The door of claim 1, wherein the return spring is wound around the coupling rod and has a support loop which is embodied between spring windings.

11. The door of claim 1, wherein the return spring is pretensioned at least in one of two ways, a first way in which the return spring is pretensioned in an open end position of the door and an accompanying pivot position of the movable handle part, a second way in which the return spring is pretensioned in a closed end position of the door and an accompanying unpivoted base position of the handle part.

12. A household appliance, comprising a door, said door comprising a plate-type base part, a handle arranged on the base part and including a movable handle part, a coupling apparatus connected to the handle part and configured to pivot the handle part relative to the base part as a function of a movement of the door, said coupling apparatus comprising a coupling rod arranged on the handle part, a return spring arranged on the coupling rod, and a single-run cable pull having an end which faces the handle part and is connected to the coupling rod, and a locking mechanism configured to limit a movement of the coupling rod.

13. The household appliance of claim 12, constructed in the form of a cooking appliance.

14. The household appliance of claim 12, wherein the locking mechanism includes a half-shell-shaped supporting molding having one end, in which the coupling rod is received.

15. The household appliance of claim 14, wherein the coupling rod is received in the end of the supporting molding in a fixed position relative to the locking mechanism.

16. The household appliance of claim 12, wherein the door includes a U-shaped movement limiter provided on a key-shaped end part of the locking mechanism.

17. The household appliance of claim 12, wherein the handle has a handle element, said handle part being pivotable relative to the handle element.

18. The household appliance of claim 5, wherein the handle element is fixed on the base part.

19. The household appliance of claim 5, wherein the handle element has a front wall and a rear wall, said door comprising a U-shaped movement limiter, said locking mechanism being configured to extend with the movement limiter into a clearance between the front wall and the rear wall and to rest on an inner side of the front wall or on an inner side of the rear wall for limiting the movement of the coupling rod.

20. The household appliance of claim 19, wherein the movement limiter is arranged with play in the clearance between the front and rear walls, as viewed in a connection direction which is oriented at a right angle between the front and rear walls.

21. The household appliance of claim 12, wherein the coupling rod defines a longitudinal axis, said handle part having a stop for axially stopping the locking mechanism when viewed in a direction of the longitudinal axis of the coupling rod.

22. The household appliance of claim 12, wherein the return spring is wound around the coupling rod and has a support loop which is embodied between spring windings.

23. The door of claim 12, wherein the return spring is pretensioned at least in one of two ways, a first way in which the return spring is pretensioned in an open end position of the door and an accompanying pivot position of the movable handle part, a second way in which the return spring is pretensioned in a closed end position of the door and an accompanying unpivoted base position of the handle part.

* * * * *